US005199338A

United States Patent [19]

Schorn et al.

[11] Patent Number: 5,199,338

[45] Date of Patent: Apr. 6, 1993

[54] AUTOMATIC WORKHOLDER AVOIDANCE SYSTEM FOR A PRESS

[75] Inventors: Gerard J. Schorn, Southampton; Maynard H. Unger, Norristown, both of Pa.

[73] Assignee: Murata Machinery, Limited, Aichi, Japan

[21] Appl. No.: 848,130

[22] Filed: Mar. 9, 1992

[51] Int. Cl.[5] ..... B26D 5/20

[52] U.S. Cl. ..... 83/13; 83/74; 83/368; 364/474.2

[58] Field of Search ..... 83/62, 74, 76.7, 13, 83/368, DIG. 1; 364/474.2, 474.19

[56] References Cited

U.S. PATENT DOCUMENTS

| | | | |
|---|---|---|---|
| 3,603,187 | 9/1971 | Bredow | 83/62 |
| 4,471,676 | 9/1984 | Mason | 364/474.2 X |
| 4,558,616 | 12/1985 | Sakamoto | 83/368 X |
| 4,589,317 | 5/1986 | Kawano | 83/62 X |
| 4,651,601 | 3/1987 | Sasaki | 364/474.2 X |

*Primary Examiner*—Frank T. Yost
*Assistant Examiner*—Kenneth E. Peterson
*Attorney, Agent, or Firm*—John R. Benefiel

[57] ABSTRACT

A collision avoidance system for program controlled punch presses which position the ram at a low "hover" height during work piece movement in which a switch is located to be tripped by inward movement of the workpiece gripper carriage to a degree in which a punch-gripper collision is possible, with the ram elevated to a safe height whenever the switch has been tripped.

2 Claims, 2 Drawing Sheets

AUTOMATIC WORKHOLDER AVOIDANCE SYSTEM FOR A PRESS

This invention concerns control systems for presses, particularly presses used for punching sheet metal workpieces.

Such presses are now commonly equipped with carriage mounted workpiece grippers which grip one edge of the workpiece. The carriage is mounted for movement on a table along one axis, and the grippers are movable on the carriage along a second orthogonal. This arrangement enables powered movement of the workpiece on the supporting table in an X-Y plane to locate a particular portion of the sheet beneath the tooling for a punching or other operation.

The gripper carriage is usually driven by a programmed NC controller to automatically conduct a sequence of operations on a particular workpiece.

In the past, the punch tooling was usually driven mechanically with a complete travel extension undergone in each punching operation from a fully retracted to a fully extended position, and back to the fully retracted position.

Presses have now been developed in which hydraulic rams are utilized, which hydraulic rams can easily position the tooling at intermediate heights. This capability has resulted in processing refinements, in which the tool may be held at a "hover" height, just above the surface of the workpiece while the sheet is being shifted to a new location. This results in increased productivity as the speed in completing the program is increased due to shortening of the punching stroke.

There is a potential problem involved in traversing the workpiece with the punch at hover height in that if the carriage is advanced in to position an area close to or at the edge of the workpiece beneath the tool, the punch could strike the gripper fingers as the grippers attempt to move past the punch.

This has required that the control program move the carriage in such a path as to avoid the gripper, or to program a temporary movement of the punch to a safe height.

However, this requires a more complex program and if a programming error is made, damage to the equipment and workpiece could result from unintended collisions of the tooling with the grippers.

The object of the present invention is to provide an improvement to presses having a "hover height" capability, in which collisions between the grippers and the tooling is avoided in a highly reliable manner not dependent on the design of the program control.

SUMMARY OF THE INVENTION

This object is achieved by an arrangement including an electrical switch tripped by a stop fixed to the gripper carriage located so as to generate an electrical control signal whenever the carriage is moved in sufficiently that there is a possiblility of a collision with the tooling. The electrical signal is processed in the press controls so as to cause the tooling to be preemptively raised to a safe height even if the program control has dictated a hover height. This provides a simple but reliable safety system which does not require special programming to be written constraining the movement of the gripper carriage or the tooling ram.

DETAILED DESCRIPTION

In the following detailed description, certain specific terminology will be employed for the sake of clarity and a particular embodiment described in accordance with the requirements of 35 USC 112, but it is to be understood that the same is not intended to be limiting ant should not be so construed inasmuch as the invention is capable of taking many forms and variations within the scope of the appended claims.

Figure 1:
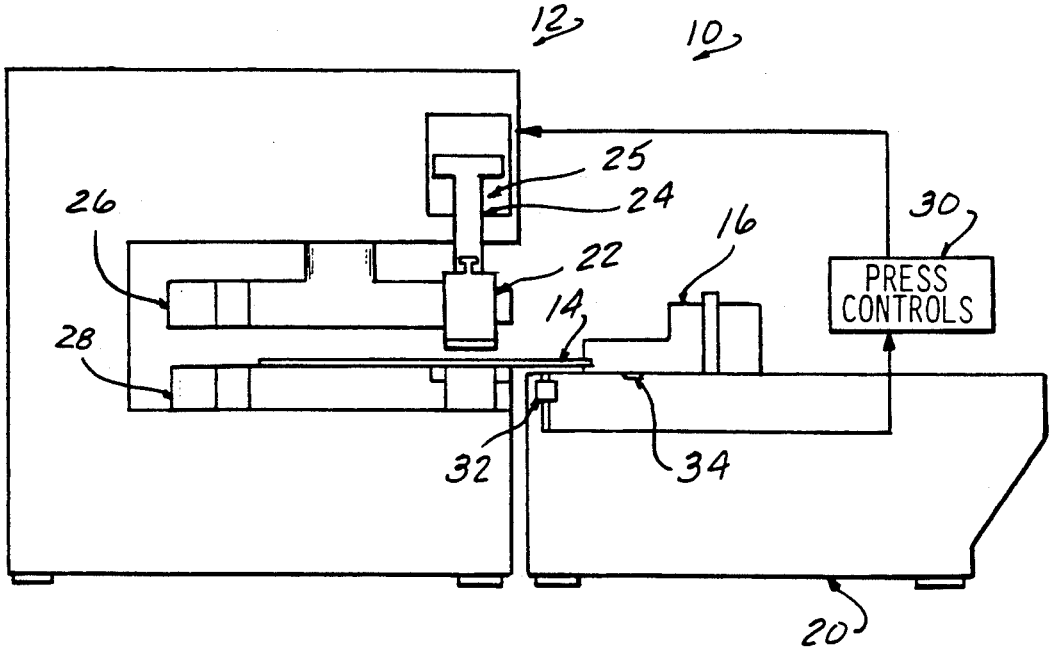
FIG. 1 is a simplified side elevational view of punch press and diagrammatic representation of the press controls incorporating a safety system according to the present invention.
Figure 2:
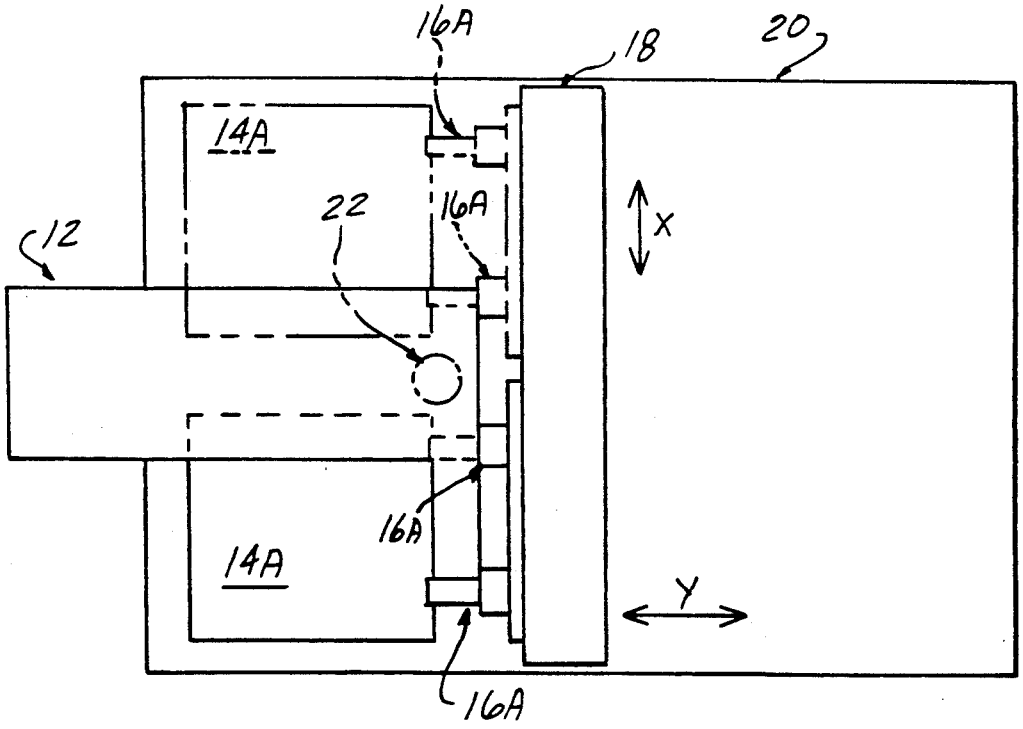
FIG. 2 is a plan View of the press shown in FIG. 1, depicting a workpiece and grippers in two shifted positions to illustrate the potential collision problem.

Referring to the Drawings, and particularly FIGS. 1 and 2, a simplified representation of a typical punch press 10 is shown.

A C-frame 12 creates an open throat which can receive a sheet workpiece 14 engaged along one edge by a series of grippers 16. Grippers 16 are mounted on a carriage 18 which can transport the grippers 16 in the "Y" direction, with the grippers 16 movable in the X direction on the carriage 18. The workpiece can thus be positioned anywhere in the plane of the X-Y axes on a supporting table 20 so as to locate any part of the workpiece beneath tooling 22 coupled to a punch ram 24. A plurality of punch tools can be mounted in an upper turret 26 and matching dies in a lower turret 28 in the manner well known in the art, with the press controls 30 bringing a selected punch and die into alignment with the ram 24.

The ram 24 is driven by a hydraulic cylinder arrangement 24 as indicated with the press controls 30, including suitable valving, directing hydraulic fluid under pressure to raise, lower, or maintain the position of the ram 24, in the manner now well known in the art.

As discussed above, the use of a hydraulically driven ram has allowed the ram to be held at a "hover" height just above the surface of the workpiece as the workpiece 14 is being shifted to a new location. This shortens the stroke to speed up the punching process. Of course, the ram 24 must be fully elevated if there is to be a tooling change to allow the upper turret to rotate to bring a new tool into alignment with the ram 24.

FIG. 2 shows that if the carriage 16 is in an advanced "in" position, the grippers 16A lie in the path of the tool 22 in moving along the X axis to the position of the grippers 16 shown in phantom. Since the hover height of the tool 22 is not sufficient to clear the grippers 16, a possibility of a collision exists, which must be taken into account by the program controlling carriage and ram motion.

According to the concept according to the present invention, an electrical sensing switch 32 is located to be tripped by carriage motion, as by a cam plate 34, when the carriage 16 and workpiece 14A are moved in sufficiently to create a collision hazard. The tripping of the switch 32 generates an electrical control signal which is transmitted to the press controls 30 which overrides the program control to cause the ram 24 to be raised to a safe height at which no collision can occur. Thus, the programming is made easier and the collision hazard eliminated.

Figure 3:
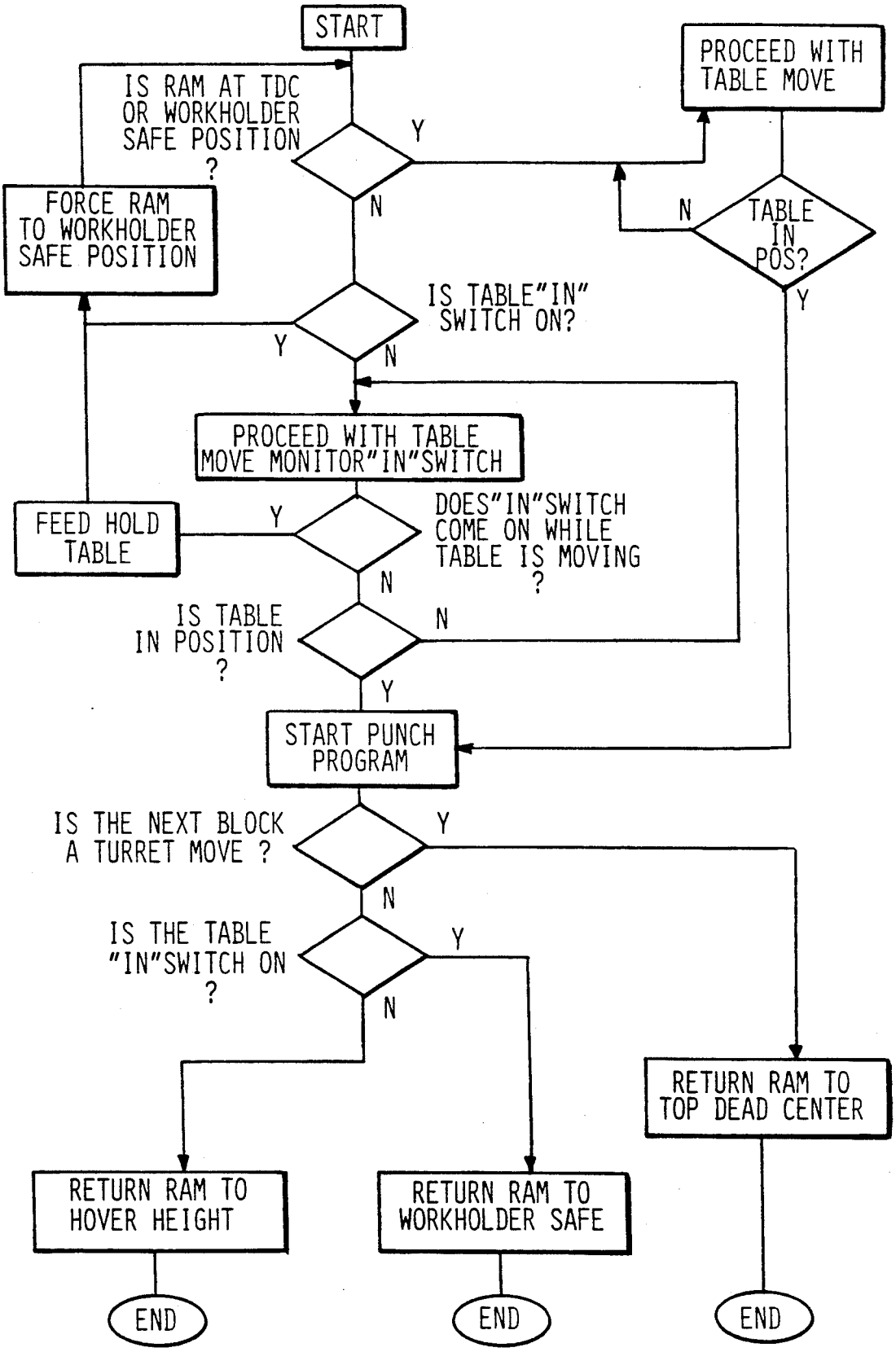
FIG. 3 is a flow diagram of the processing of the electrical control signal from the switch incorporated in the safety system according to the present invention.

FIG. 3 is a flow chart for suitable programming to implement the above control scheme.

This flow chart shows the carriage overall control scheme with the safety switch override control scheme integrated therein. The flow chart can easily be implemented by suitable software programming by those skilled in the art.

We claim:

1. In a punch press of the type including a hydraulically actuated punch ram, punch tooling adapted to be coupled to said punch ram, workpiece grippers adapted to grip one edge of a sheet material workpiece to be punched, a gripper carriage for positioning selected portions of said workpiece beneath said ram by movement along orthogonal X and Y axes, and press controls for automatically moving said workpiece to particular locations as a part of a punch program control, said press controls keeping said ram at a lowered hover height to position tooling just above said workpiece during traversing of said gripper carriage, the improvement comprising:

a sensor switch located to be tripped to generate an electrical control signal upon movement of said gripper carriage in towards said ram to a predetermined extent whereat there is established a possibility of a collision between said tooling and said grippers with said tooling at said hover height, and program control means responsive to said electrical control signal to override said press controls and cause said ram to be elevated from said hover height to a higher safe height above said workpiece, whereat the possibility of a collision between said grippers and said tooling does not exist.

2. A method of controlling programmed punch press operation of the type in which a hydraulically actuated ram drives punch tooling through a workpiece, said workpiece positioned by a movable carriage having grippers engaging one side of said workpiece and press controls including a programmed control automatically controlling carriage movement to locate predetermined portions of said workpiece beneath said tooling, said press controls automatically moving said ram to position said tooling at a hover height just above said workpiece during movement of said carriage between locations whereat punching operations are performed, said method comprising the steps of:

positioning an electrical switch at a location to be tripped by movement of said carriage towards said ram to a predetermined point whereat there is a possibility of a collision of said grippers with said tooling; and overriding said press controls and raising said ram to a safe height higher than said grippers whenever said electrical switch is tripped.

* * * * *